US007304617B2

(12) United States Patent
Lynch

(10) Patent No.: US 7,304,617 B2
(45) Date of Patent: Dec. 4, 2007

(54) MILLIMETER-WAVE TRANSREFLECTOR AND SYSTEM FOR GENERATING A COLLIMATED COHERENT WAVEFRONT

(75) Inventor: Jonathan Lynch, Oxnard, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/100,200

(22) Filed: Apr. 5, 2005

(65) Prior Publication Data

US 2006/0220973 A1 Oct. 5, 2006

(51) Int. Cl.
*H01Q 15/02* (2006.01)

(52) U.S. Cl. ..... 343/909; 343/756; 333/202

(58) Field of Classification Search ..... 343/756, 343/909; 333/202, 134
See application file for complete search history.

(56) References Cited

U.S. PATENT DOCUMENTS 3,267,480 A 8/1966 Lerner
3,276,023 A 9/1966 Dorne et al.
4,701,765 A * 10/1987 Arduini et al. ..... 343/897
5,162,809 A * 11/1992 Wu ..... 343/909
5,543,815 A * 8/1996 Wu et al. ..... 343/909
5,959,594 A * 9/1999 Wu et al. ..... 343/909
6,147,572 A * 11/2000 Kaminski et al. ..... 333/134
6,208,316 B1 * 3/2001 Cahill ..... 343/909
6,218,978 B1 * 4/2001 Simpkin et al. ..... 342/5

FOREIGN PATENT DOCUMENTS

EP 1 120856 A 8/2000

* cited by examiner

*Primary Examiner*—Tan Ho
(74) *Attorney, Agent, or Firm*—Schwegman, Lundberg & Woessner, P.A.; Gregory J. Gorrie

(57) ABSTRACT

A planar multi-layer transreflector for generating collimated coherent energy comprises one or more of insulating layers between two or more metallic layers. The transreflector substantially reflects a cross-polarized component of an incident millimeter-wave signal and substantially transmits the remaining portions of the incident millimeter-wave signal. Each of the metallic layers comprises a plurality of rectangles arranged in a grid pattern radially varying in size within circumferential regions. The reflected cross-polarized component may be substantially orthogonal to the transmitted remaining portions. A substantially collimated and coherent wavefront comprising the remaining portions may be produced in a first direction, and substantially collimated and coherent wavefront comprising the cross-polarized components may be produced in a second direction.

24 Claims, 5 Drawing Sheets

MILLIMETER-WAVE TRANSREFLECTOR AND SYSTEM FOR GENERATING A COLLIMATED COHERENT WAVEFRONT

TECHNICAL FIELD

Some embodiments of the present invention pertain to millimeter-wave systems. Some embodiments relate to the generation of coherent energy.

BACKGROUND

Conventional techniques for concentrating, collimating and/or focusing microwave and millimeter-wave energy generally use curved surfaces and apply optical theory. To generate coherent energy having a single polarization, dielectric lenses, such as a Lundberg lens, have been used. These lenses are complex and difficult to construct. Furthermore, it is difficult to generate sufficiently coherent and/or collimated energy for some applications with these conventional lenses.

Thus there are general needs for improved apparatus and methods that provide for concentrating, collimating and/or focusing microwave and millimeter-wave energy.

SUMMARY

A planar multi-layer transreflector for generating collimated coherent energy comprises one or more of insulating layers between two or more metallic layers disposed on the insulating layers. The transreflector substantially reflects a cross-polarized component of an incident millimeter-wave signal and substantially transmits remaining portions of the incident millimeter-wave signal. Each of the metallic layers comprises a plurality of rectangles arranged in a grid pattern radially varying in size within circumferential regions. A substantially collimated and coherent wavefront comprising the remaining portions is produced.

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to limit the scope of this application to any single invention or inventive concept if more than one is in fact disclosed.

Figure 1:
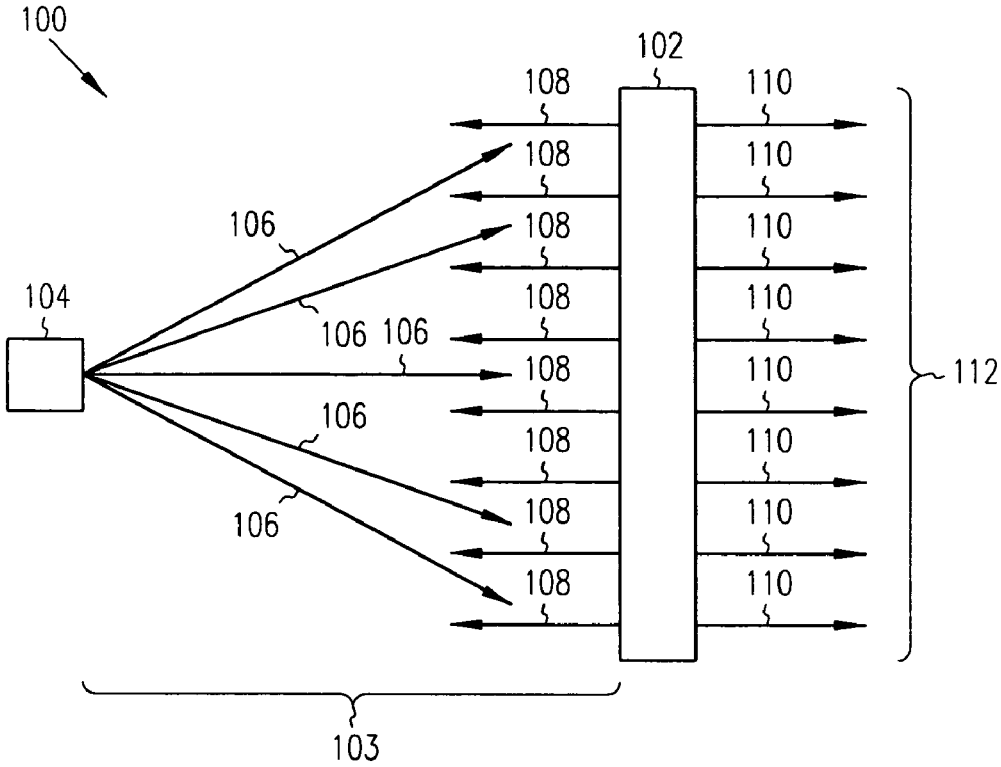
FIG. 1 is an illustration of a millimeter-wave collimated coherent wavefront generating system in accordance with some embodiments of the present invention.

FIG. 1 is an illustration of a millimeter-wave collimated coherent wavefront generating system in accordance with some embodiments of the present invention. Millimeter-wave collimated coherent wavefront generating system 100 may be used for generating collimated coherent millimeter-wave energy and may comprise planar multilayer transreflector 102 and millimeter-wave source 104. Millimeter-wave source 104 may be positioned at a focus of transreflector 102 and may provide incident millimeter-wave signal 106. Multilayer transreflector 102 may substantially reflect cross-polarized component 108 of incident millimeter-wave signal 106 and may substantially transmit remaining portions 110 of incident millimeter-wave signal 106 to generate collimated coherent millimeter-wave wavefront 112. In these embodiments, cross-polarized component 108 may be substantially orthogonal to the polarization of incident millimeter-wave signal 106 and may substantially transmit remaining portions 110 of incident millimeter-wave signal 106.

In some embodiments, multilayer transreflector 102 may comprise a plurality of insulating layers arranged between metallic layers. The metallic layers each may comprise a plurality of rectangles arranged in a grid pattern that may vary radially within circumferential regions to allow multilayer transreflector 102 to substantially reflect cross-polarized component 108 of incident millimeter-wave signal 106 and to substantially transmit remaining portions 110 of incident millimeter-wave signal 106. Remaining portions 110 may include a cross-polarized component as well as a co-polarized component of incident millimeter-wave signal 106. Embodiments of this are described in more detail below.

Although some embodiments are described herein as substantially reflecting a cross-polarized (i.e., orthogonal) component, the scope of the invention is not limited in this respect. Other embodiments of the present invention may reflect a co-polarized component (i.e., having the same polarization) of incident millimeter-wave signal 106 and may transmit the remaining portions.

In some embodiments, source 104 may comprise a microwave or millimeter-wave amplifier array with orthogonally polarized input and output antennas to receive reflected cross-polarized component 108 and transmit co-polarized incident millimeter-wave signal 106. Example embodiments of this are discussed in more detail below. In other embodiments, source 104 may be a microwave or millimeter-wave point source, although the scope of the invention is not limited in this respect.

Figure 2A:
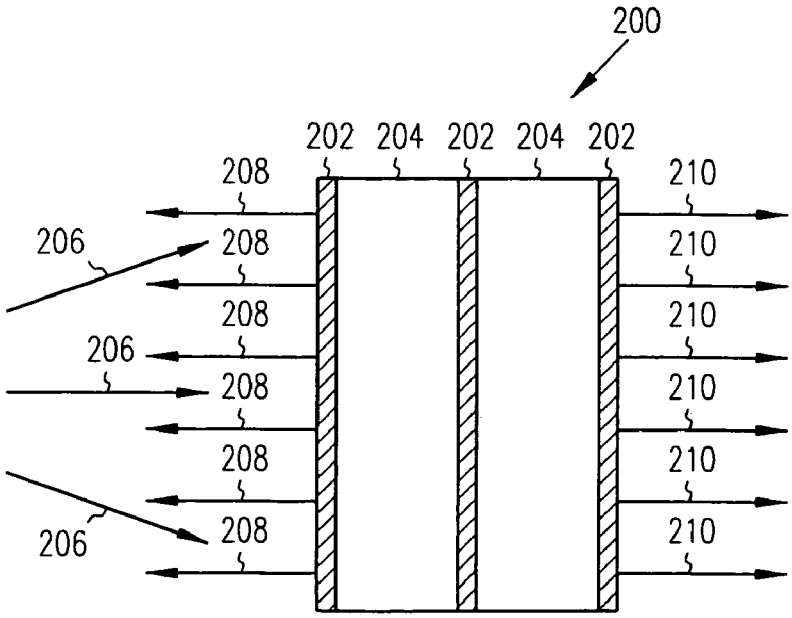
FIG. 2A illustrates a side view of a multilayer transreflector in accordance with some embodiments of the present invention.
Figure 2B:
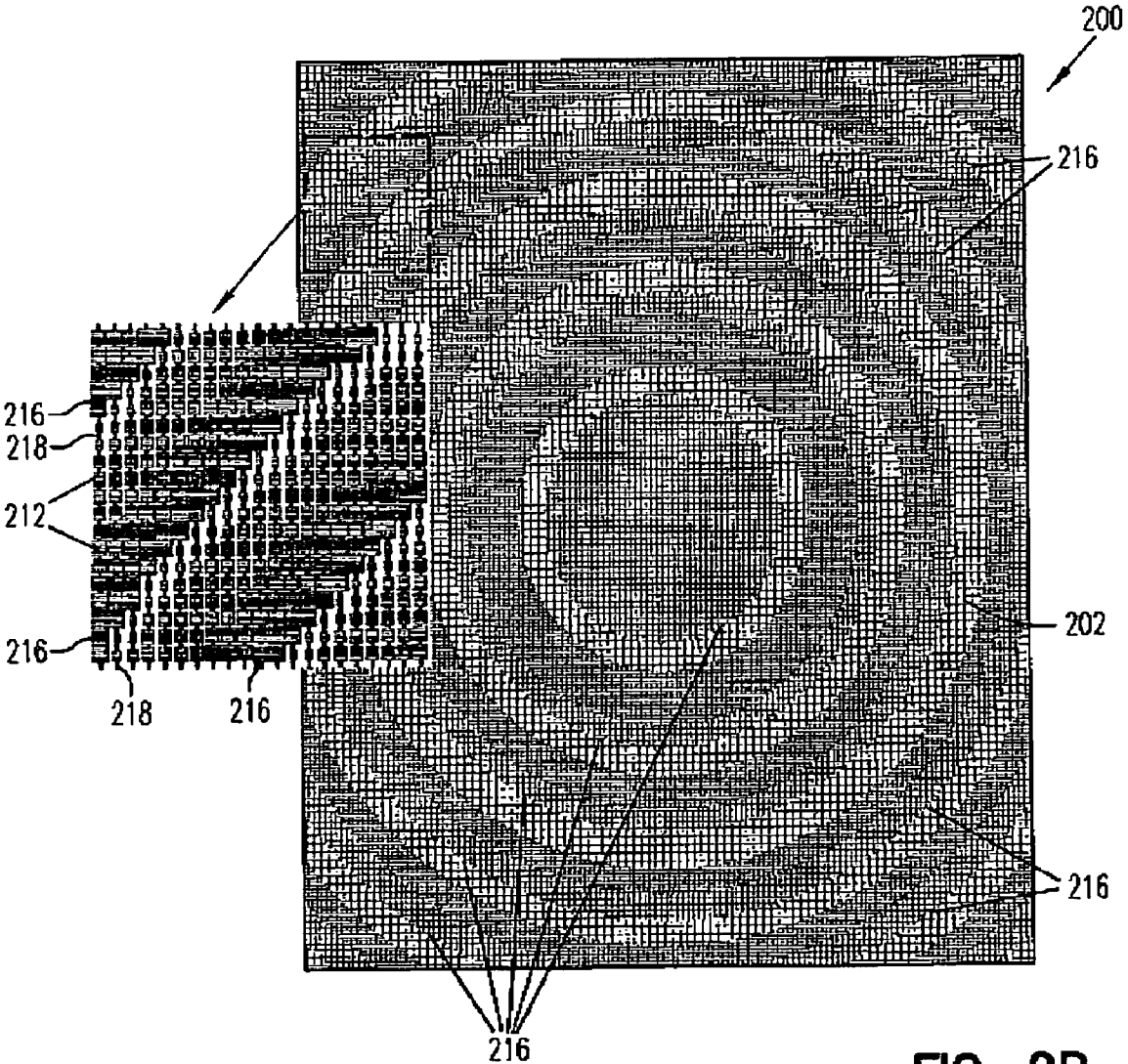
FIG. 2B illustrates a top view of a metallic layer of the transreflector of FIG. 2A.

FIG. 2A illustrates a side view of a multilayer transreflector in accordance with some embodiments of the present invention. FIG. 2B illustrates a top view of a metallic layer of the multilayer transreflector of FIG. 2A including an exploded view of a portion of the metallic layer. Multilayer transreflector 200 may be suitable for use as transreflector 102 (FIG. 1) although other transreflectors may also be used. Transreflector 200 may comprise one or more insulating layers 204 and metallic layers 202 disposed on the one or more insulating layers 204. This combination may substantially reflect cross-polarized component 208 of incident millimeter-wave signal 206 and may substantially transmit remaining portions 210 of incident millimeter-wave signal 206. In some embodiments, reflected cross-polarized components 208 may be a substantially collimated and a substantially coherent wavefront. In some embodiments, transmitted remaining portions 210 may be a substantially collimated and a substantially coherent wavefront.

As illustrated in FIG. 2B, metallic layer 202 may comprise a plurality of rectangles 212 arranged in a grid pattern. The size of rectangles 212 may radially vary in size within each of circumferential regions 216 (i.e., rings).

In some embodiments, the plurality of rectangles 212 may vary in size radially outward from larger to smaller within each of circumferential regions 216. In some other embodiments, the plurality of rectangles 212 may vary in size radially outward from smaller to larger within each of circumferential regions 216. In some embodiments, rectangles 212 may be squares, although the scope of the invention is not limited in this respect. The plurality of rectangles 212 may be electrically coupled by connecting lines 218 in either an x-direction or a y-direction. In some embodiments, connecting lines 218 may provide inductive reflections for polarization along lines 218 and may provide capacitive reflections for polarization orthogonal to lines 218. In this way, remaining portions 210 may be substantially transmitted and cross-polarized component 208 of incident millimeter-wave signal 106 may be substantially reflected. The use of connecting lines 218 in both the x and y directions would inhibit this.

In some embodiments, multilayer transreflector 200 may comprise two metallic layers 202 and one insulating layer 204 between metallic layers 202. In some embodiments, multilayer transreflector 200 may comprise three metallic layers 202 and two insulating layers 204 between metallic layers 202. In some two and three-metallic layer embodiments, each of metallic layers 202 may be substantially identical and/or symmetric. In some other three metallic-layer embodiments, the middle metallic layer may be different than the outer metallic layers. In some two-layer embodiments, the two metallic layers may be different. Differences between metallic layers 202 may include the radial spacing between circumferential regions 216, size and variation of rectangles 212, the spacing between rectangles 212, and/or a width of connecting lines 218. The variation between layers 202 may be selected to transmit a substantially collimated and substantially coherent wavefront of remaining portions 210 that may be generated from the incident millimeter-wave signal 206. The variation between layers 202 may also be selected to reflect a substantially collimated and substantially coherent wavefront of cross-polarized components 208 that may be generated from the incident millimeter-wave signal 206.

In some embodiments, a radial spacing between circumferential regions 216, size and variation of the rectangles 212, a spacing between rectangles 212, a width of connecting lines 218 and/or a thickness of insulating material 204 may be selected so that the grid pattern of the metallic layers together with the insulating layers may generate substantially collimated and substantially coherent wavefronts of reflected and transmitted polarizations, although the scope of the invention is not limited in this respect.

In some embodiments, transreflector 200 may be illuminated by a millimeter-wave point source 104 (FIG. 1) positioned at a focal point which may be focal distance 103 (FIG. 1) from transreflector 200. The focal point may be defined as a location in which the reflected and/or transmitted wavefront is collimated, although the scope of the invention is not limited in this respect.

In some embodiments, transreflector 200 may be substantially circular and the focal distance may be approximately equal to the diameter, although the scope of the invention is not limited in this respect. In other embodiments, transreflector 200 may be square or rectangular in shape, although other shapes are also suitable. In these embodiments, metallic layers 202 may be arranged circularly; however insulating layers 204 may extend beyond the diameter of the metallic layer's area for coupling with structural components of the system.

In some embodiments, incident millimeter-wave signal 206 may be generated by millimeter-wave point source 104 (FIG. 1). In some embodiments, incident millimeter-wave signal 206 may either be right-hand or left-hand circularly polarized, although the scope of the invention is not limited in this respect.

In some embodiments, transreflector 200 may be positioned at 45 degrees with respect to incident millimeter-wave signal 206. In this situation, incident millimeter-wave signal 206 may have a polarization that is substantially 45 degrees with respect to the grid structure of transreflector 200. In some other embodiments, source 104 (FIG. 1) may be linearly polarized, while in other embodiments, source 104 (FIG. 1) may be either right or left hand circularly polarized, although the scope of the invention is not limited in this respect.

In some embodiments, circumferential regions 216 may vary radially from a center based on the relation: $k*\mathrm{sqrt}(r^2+f^2)$ in which k is the wave number in radians per unit length, r is the radial distance from the center, and f is a focal distance. In this equation, k is the radian frequency in radians/sec divided by the speed of light. In this way, the grid pattern of the metallic layers may have a radial dependence and no azimuth dependence. In some embodiments, the grid pattern may be fixed (i.e., the locations of the centers of the squares may be fixed) while the size of squares may be varied. In some embodiments, circumferential regions 216 (i.e., rings) may correspond to a particular reflection phase, although the scope of the invention is not limited in this respect.

In some embodiments, insulating layer 204 comprises a microwave dielectric material, such as ceramic, quartz, Duroid, etc., although the scope of the invention is not limited in this respect. In some embodiments, metallic layer 202 may include conductive material such as copper, gold, silver, aluminum, etc. and alloys thereof. In some embodiments, each metallic layer 202 may be deposited on one of insulating layers 204 using a process such as electroplating or sputtering. Photolithography, for example, may be used for the patterning of metallic layer 202, although the scope of the invention is not limited in this respect.

Figure 3:
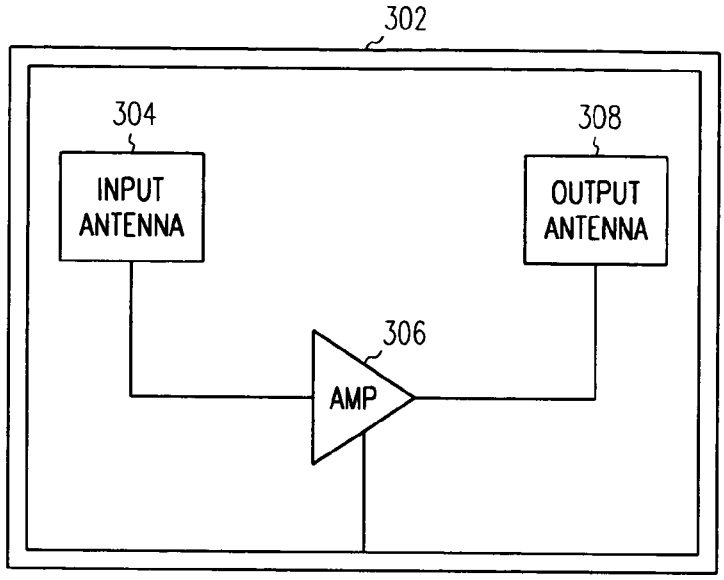
FIG. 3 illustrates an array element of an amplifier array suitable for use with some embodiments of the present invention.

FIG. 3 illustrates an array element of an amplifier array suitable for use with some embodiments of the present invention. The amplifier array may comprise a plurality (e.g., up to several hundred or more) of array elements 302. The amplifier array may be suitable for use a source, such as source 104 (FIG. 1) for generating incident millimeter-wave energy for collimation by transreflector 200 (FIG. 2), although the scope of the invention is not limited in this respect as point sources may also be suitable. The amplifier array may be referred to as a reflect array.

In some embodiments, the amplifier array may be positioned at or near a focal point of transreflector 200 (FIG. 2) to receive reflected cross-polarized component 208 (FIG. 2). Each array element 302 may amplify the received cross-polarized component 208 (FIG. 2) and responsively transmit signals co-polarized signals which are orthogonal to the received cross-polarized component.

In some embodiments, each array element 302 may comprise input antenna 304 having a first polarization to receive reflected cross-polarized component 208 (FIG. 2), millimeter-wave amplifier 306 to amplify the reflected cross-polarized component, and output antenna 308 coupled to an output of amplifier 306. In some embodiments, output antenna 308 may have a polarization orthogonal to the polarization to input antenna 304 to transmit the signals orthogonal to the received cross-polarized component 208 (FIG. 2). As these co-polarized components are generated and transmitted by the array and as cross-polarized components 108 (FIG. 1) are reflected back from transreflector 102 (FIG. 1), the amplifiers of array elements 302 may oscillate at the desired millimeter-wave frequency allowing system 100 to generate wavefront 112 (FIG. 1).

In some embodiments, the amplifier array may receive collimated cross-polarized component 108 (FIG. 1), which may be a coherent wavefront allowing the amplifier array to generate a coherent reflected wavefront comprising co-polarized components. In these embodiments, the amplifier array may be at least the same size as transreflector 102 (FIG. 1) to receive substantially the entire wavefront of collimated cross-polarized component 108 (FIG. 1).

In some other embodiments, output antenna 308 may have the same polarization as input antenna 304, although the scope of the invention is not limited in this respect.

In some embodiments, the pattern of metallic layers 202 (FIG. 2) may be viewed as aperiodic frequency selective structures (FSSs) in which the grid pattern may vary across the surface in such a way to as to provide a particular reflection and transmission phase at each location on the surface. By adjusting the pattern across the surface, a desired reflection and transmission phase shift at every point may be produced which modifies the phase front on an incident wave to produce collimation. The following analysis may describe the scattering characteristics of the pattern so that it may be designed to produce the desired result.

Figure 4:
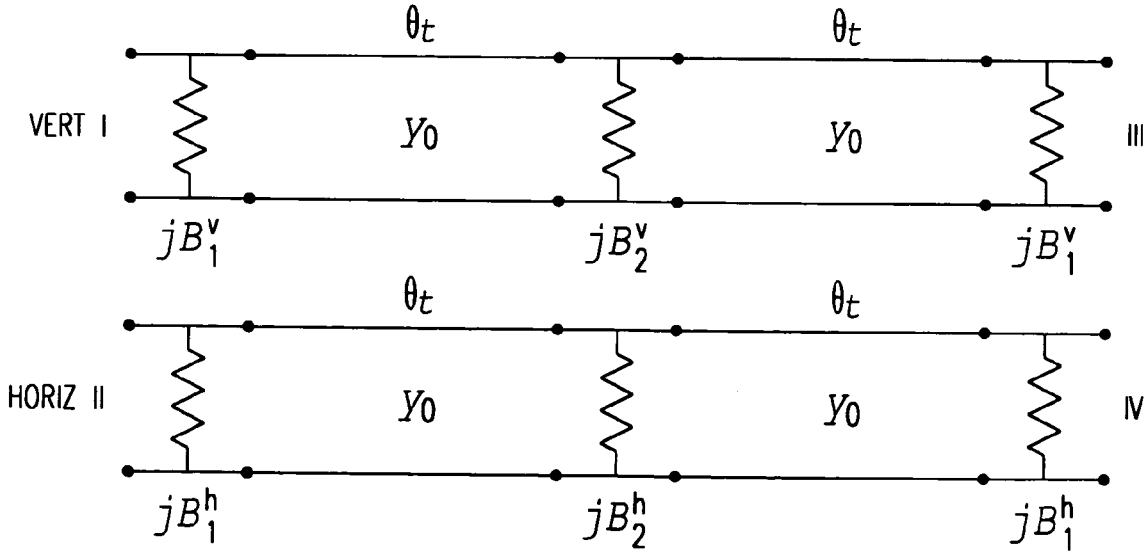
FIG. 4 illustrates an equivalent circuit for a multilayer transreflector in accordance with some embodiments of the present invention.

For this analysis, it is assumed that transreflector 200 (FIG. 2) is electrically large so that the FSS characteristics change relatively slowly across the transreflector. This may be the case when the ratio of the diameter at the focal distance is close to unity. At each location on the surface, the scattering behavior may be approximated by the behavior of an infinite uniform periodic pattern. This may be repeated for each location across the transreflector. For this analysis, the transreflector's grid may be oriented at about 45 degrees with respect to the polarization of the source. The incident polarization may be resolved into two orthogonal components (herein referred to as principal axes) that lie along the grid axes. FIG. 4 shows the equivalent circuits for the structure with each circuit representing scattering in each of the two principal polarizations, referred to as horizontal and vertical polarizations. In FIG. 4, the shunt susceptances are chosen to provide desired reflection and transmission values and may vary across the surface to produce collimation. In this analysis of a three-metallic layer transreflector, the two outermost layers may be identical. This constraint may simplify the design and may help ensure focusing/collimation for both reflection and transmission simultaneously. The four port scattering matrix as seen from the source, which for this analysis is rotated 45 degrees with respect to the transreflector, has the form shown below due to symmetry and reciprocity.

$$S = \begin{pmatrix} S_{11} & S_{12} & T_{11} & T_{12} \\ S_{12} & S_{11} & T_{12} & T_{11} \\ T_{11} & T_{12} & S_{11} & S_{12} \\ T_{12} & T_{11} & S_{12} & S_{11} \end{pmatrix}$$

To obtain the desired characteristics, $S_{11}$ should be zero for zero co-polarized reflection and $|S_{12}|=\alpha$ for a specific cross-polarized reflection. The power not reflected may be transmitted through the transreflector as remaining portions 110 (FIG. 1) with a small fraction being absorbed by the losses in the structure. In addition, the susceptance values may be adjusted so that the phase of the reflection coefficient varies across the surface so that $\theta=\angle S_{12}$ may take on any desired value.

The dielectric constant and thickness of insulating layers 204 (FIG. 2) result in an equivalent transmission line characteristic admittance and electrical length equal to $Y_1=Y_o\sqrt{\in_r}$ and $$\theta_t = 2\pi\sqrt{\varepsilon_r}\,\frac{d}{\lambda\cos(\theta_i)}$$

respectively, where $Y_o=1/377\Omega$ is the admittance of free space, $\in_r$ is the relative permittivity of the board material, d is the thickness of an insulating layer, and $\theta_i$ is the angle of incidence in which zero degrees is normal incidence. Choosing a lower dielectric constant material may result in a narrower range of susceptance values that need to be realized simplifying the design process and possibly providing more robust results. In addition, values of insulating layer thickness close to a quarter wavelength for each insulating layer seem may provide better results, although the scope of the invention is not limited in this respect.

Analysis of this transreflector structure provides the following values of frequency selective structure susceptances that may provide some desired characteristics:

$$\begin{cases} B_1^v = Y_1\cot(\theta_t) - Y_o\cot\left(\frac{1}{2}\left(\sin^{-1}\alpha - \theta + \frac{\pi}{2}\right)\right) \\ B_2^v = Y_1\cot(\theta_t)\left(1 - \frac{Y_1}{Y_o\sin(2\theta_t)}\frac{\alpha+\cos(\theta)}{\sqrt{1-\alpha^2}}\right) \end{cases}$$

$$\begin{cases} B_1^h = Y_1\cot(\theta_t) + Y_o\tan\left(\frac{1}{2}\left(\sin^{-1}\alpha - \theta + \frac{\pi}{2}\right)\right) \\ B_2^h = Y_1\cot(\theta_t)\left(1 - \frac{Y_1}{Y_o\sin(2\theta_t)}\frac{\alpha-\cos(\theta)}{\sqrt{1-\alpha^2}}\right) \end{cases}$$

Figure 5A:
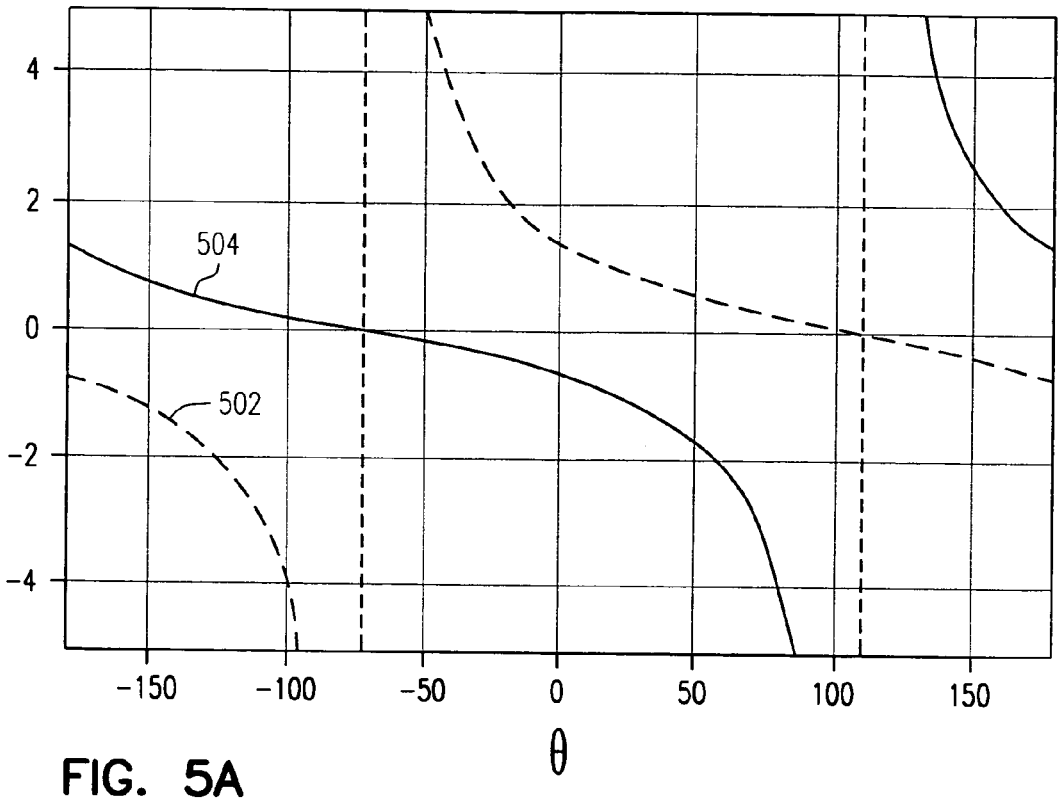
FIGS. 5A and 5B illustrates example of plots of four susceptance values that result in a preselected reflection phase.
Figure 5B:
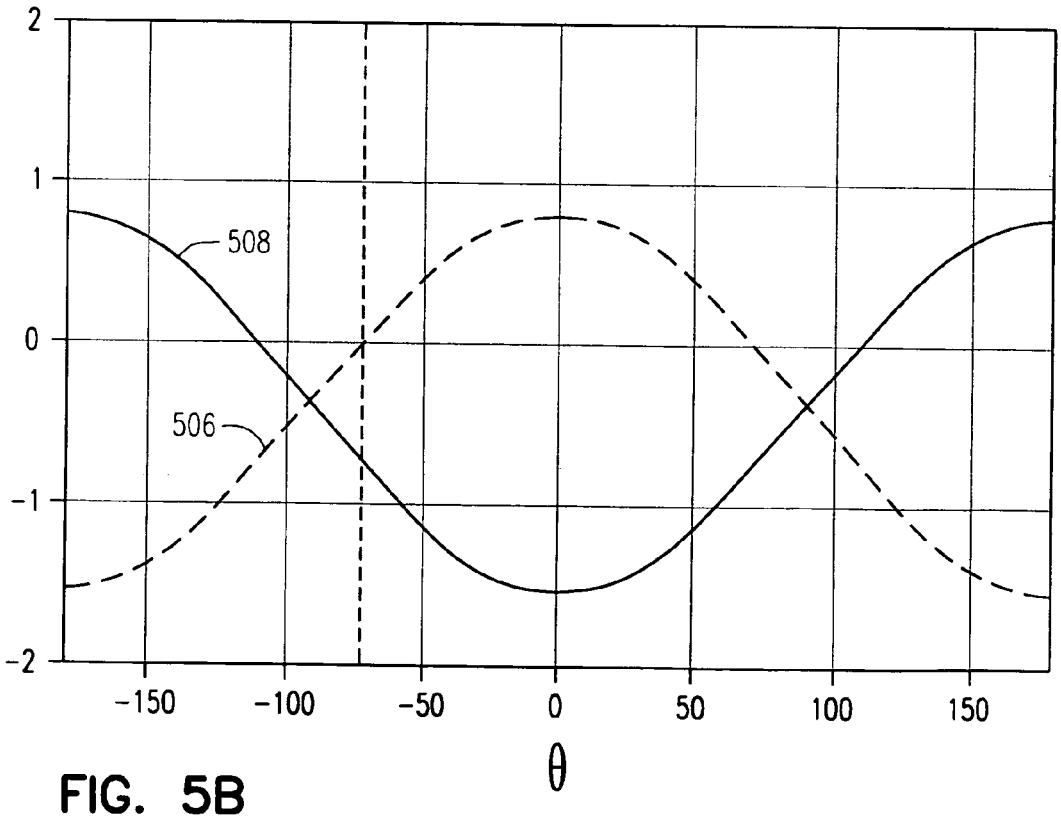

In some example embodiments, a dielectric material with a relative dielectric constant of 2.2 may be used for insulating layers 204 (FIG. 2). The electrical thickness of each layer may be assumed to be 90 degrees for simplicity, although this value will change in practice due to the fact that the angle of incidence and the equivalent electrical thickness $\theta_t$ may vary across the surface. A value of $\alpha=0.316$ may be chosen to produce 10% reflected power as cross-polarized component 108 (FIG. 1). FIGS. 5A and 5B show the values for the four susceptances that produce a given reflection phase 6. Reference designation 502 corresponds to susceptance $B_1^h$, reference designation 504 corresponds to susceptance $B_1^v$, reference designation 506 corresponds to susceptance $B_2^h$, and reference designation 508 corresponds to susceptance $B_2^v$ in the above equations. These plots may be used to determine the patterns across the surface of the transreflector, as described below. The resulting four port scattering matrix magnitudes, as seen from the source, may be described as follows:

$$|S| = \begin{pmatrix} 0 & 0.316 & 0 & 0.949 \\ 0.316 & 0 & 0.949 & 0 \\ 0 & 0.949 & 0 & 0.316 \\ 0.949 & 0 & 0.316 & 0 \end{pmatrix}.$$

In this way, $\angle S_{12}=\theta$ and the angle of the transmission coefficient may be $$\angle T_{12} = \theta + \frac{\pi}{2}.$$

This may help ensure that collimation of the reflected waves may also result in collimation of the transmitted waves.

The example plots illustrated in FIGS. 5A and 5B may be used to design a collimating transreflector in the following way. After choosing a suitable diameter and focal length, a source (with diameter $D_o$) may be placed at the focal point and the phase of the incident field may be determined at the transreflector's surface. For a Gaussian beam source with a beam waist located at a distance z behind the transreflector, the phase fronts on the surface may be described by the following equation:

$$\theta_i(r) = -2\pi\frac{z}{\lambda}\left(1 + \frac{1}{2}\frac{r^2}{z^2 + \left(\frac{\pi D_o^2}{4\lambda}\right)^2}\right).$$

Figure 6:
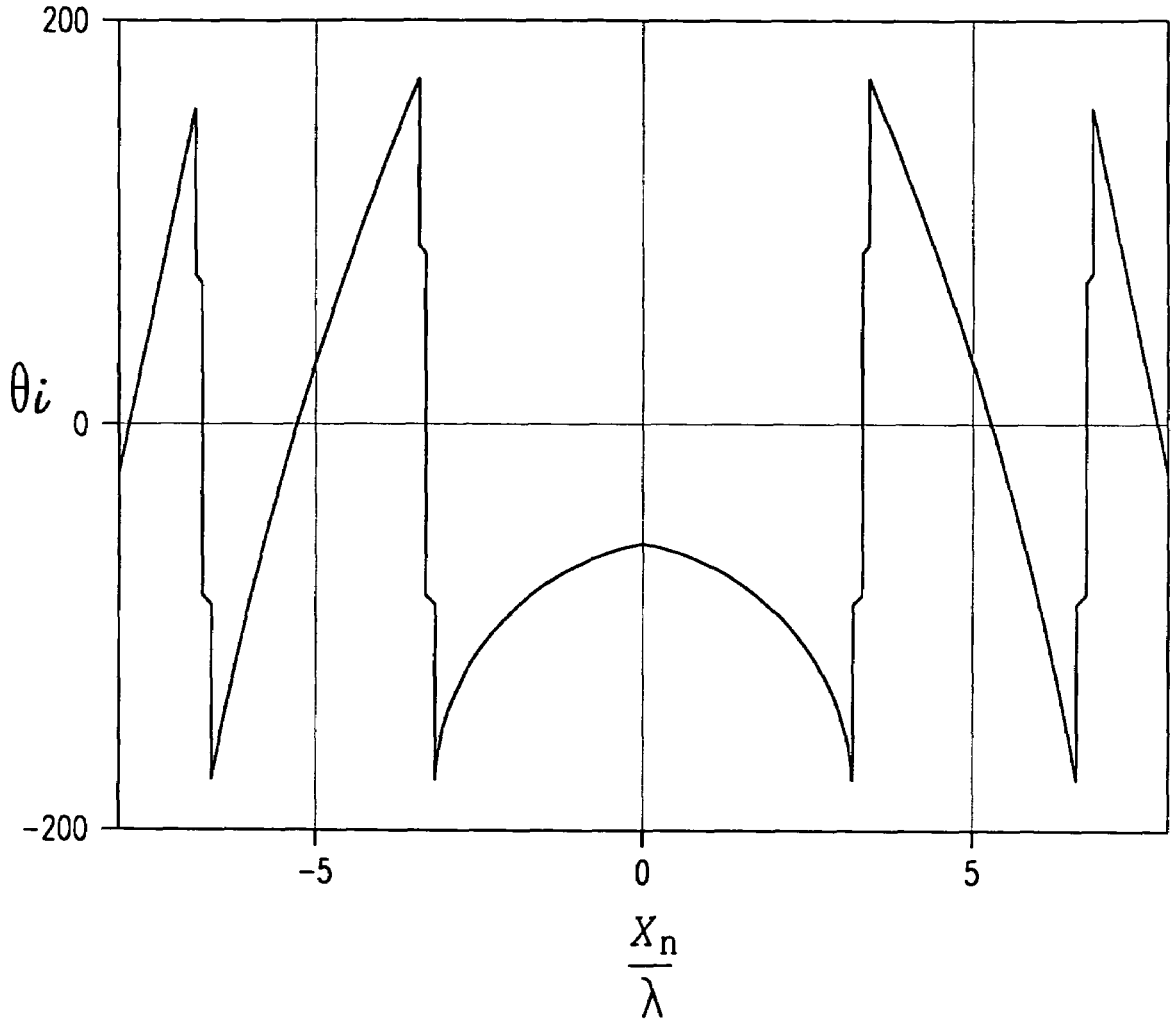
FIG. 6 is an example of a plot of phase variation across a center of a multilayer transreflector in accordance with some embodiments of the present invention.

An example of the phase variation is plotted in FIG. 6. The independent variable in the plot is the radial direction from the transreflector center in wavelengths. A transreflector that reflects and transmits with the negative of this phase distribution (i.e., $\angle S_{12}=-\theta_i(r)$) may collimate both the reflected and transmitted beams.

After specifying the phase distribution, FSS cells may be designed that produce the desired scattering. A suitable electromagnetic code may be used for this purpose, such as Ansoft's HFSS code, or a Method of Moments code. First, a unit cell size is chosen. In practice, smaller unit cells may give more robust results, but a too small cell size may limit the realizable susceptance values. In some embodiments, a unit cell size of ~0.4λ may be sufficient. The surface may be divided into a grid of unit cells and the average phase of each cell may be given by $-\theta_i(r)$ above. From the phase at each location, the desired susceptances may be determined using the equations above. The two outer metallic layers, for example, may be designed using the electromagnetic code to provide the desired susceptance values.

Thus, a planar multi-layer transreflector, a system and a design method have been described for generating collimated coherent energy. In some embodiments, the transreflector comprises one or more of insulating layers between two or more metallic layers. In some embodiments, the transreflector substantially reflects a cross-polarized component of an incident millimeter-wave signal and substantially transmits remaining portions of the incident millimeter-wave signal. The reflected cross-polarized component may be amplified by a reflective array of amplifiers which transmit a co-polarized incident signal.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus the following claims are hereby incorporated into the detailed description, with each claim standing on its own as a separate preferred embodiment.

What is claimed is:

1. A planar multi-layer transreflector for generating collimated coherent energy comprising:

an insulating layer; and a metallic layer disposed on the insulating layer to substantially reflect a first portion of an incident millimeter-wave signal and substantially transmit through the transreflector remaining portions of the incident millimeter-wave signal, wherein the metallic layer comprises a plurality of conductive rectangles arranged in a grid pattern radially varying in size within circumferential regions, wherein the first portion has a polarization substantially orthogonal to the incident millimeter-wave signal, wherein the conductive rectangles are electrically coupled to at least some other rectangles within the circumferential regions, and wherein the circumferential regions are defined by concentric circles about a center of the transreflector.

2. The transreflector of claim 1 wherein the plurality of rectangles vary in size radially outward from smaller to larger within each of the circumferential regions.

3. The transreflector of claim 1 wherein the plurality of rectangles are electrically coupled by connecting lines in either an x-direction or a y-direction to substantially reflect the first portion having the polarization substantially orthogonal to the incident millimeter-wave signal.

4. The transreflector of claim 3 wherein the metallic layer is one of three metallic layers, and wherein the insulating layer is one of two insulating layers disposed between the metallic layers.

5. A planar multi-layer transreflector for generating collimated coherent energy comprising:

an insulating layer; and a metallic layer disposed on the insulating layer to substantially reflect a first portion of an incident millimeter-wave signal and substantially transmit through the transreflector remaining portions of the incident millimeter-wave signal, wherein the metallic layer comprises a plurality of rectangles arranged in a grid pattern radially varying in size within circumferential regions, wherein the first portion has a polarization substantially orthogonal to the incident millimeter-wave signal, and wherein the plurality of rectangles vary in size radially outward from larger to smaller within each of the circumferential regions.

6. A planar multi-layer transreflector for generating collimated coherent energy comprising:

an insulating layer; and a metallic layer disposed on the insulating layer to substantially reflect a first portion of an incident millimeter-wave signal and substantially transmit through the transreflector remaining portions of the incident millimeter-wave signal, wherein the metallic layer comprises a plurality of rectangles arranged in a grid pattern radially varying in size within circumferential regions, wherein the first portion has a polarization substantially orthogonal to the incident millimeter-wave signal, wherein the plurality of rectangles are electrically coupled by connecting lines in either an x-direction or a y-direction to substantially reflect the first portion having the polarization substantially orthogonal to the incident millimeter-wave signal, wherein the metallic layer is one of three metallic layers, and wherein the insulating layer is one of two insulating layers disposed between the metallic layers, wherein the first portion comprises cross-polarized components of the incident millimeter wave signal, and wherein a radial spacing between the circumferential regions, size and variation of the rectangles, a spacing between the rectangles, and a width of the connecting lines are selected to generate a substantially collimated and substantially coherent wavefront of the remaining portions from the incident millimeter-wave signal and to reflect a substantially collimated and substantially coherent wavefront comprising the cross-polarized components.

7. The transreflector of claim 6 wherein the transreflector is illuminated by a millimeter-wave source positioned a focal point of the transreflector.

8. The transreflector of claim 6 wherein the incident millimeter-wave signal is generated by a millimeter-wave point source, and wherein the incident millimeter-wave signal is either right-hand or left-hand circularly polarized.

9. The transreflector of claim 6 wherein the incident millimeter-wave signal is generated by an amplifier array positioned near a focal point of the transreflector, the amplifier array to receive the reflected cross-polarized component, to amplify the received cross-polarized component and responsively transmit signals orthogonal to the received cross-polarized component for receipt by the transreflector as the incident millimeter-wave signal.

10. The transreflector of claim 9 wherein the amplifier array comprises a plurality of array elements, wherein each array element comprises:

an input antenna having a first polarization to receive the reflected cross-polarized component;

a millimeter-wave amplifier to amplify the reflected cross-polarized component; and an output antenna coupled to an output of the amplifier to transmit signals with a polarization orthogonal to the reflected cross-polarized component, wherein the array elements are to oscillate at a millimeter-wave frequency of the incident millimeter-wave signal.

11. A planar multi-layer transreflector for generating collimated coherent energy comprising:

an insulating layer; and a metallic layer disposed on the insulating layer to substantially reflect a first portion of an incident millimeter-wave signal and substantially transmit through the transreflector remaining portions of the incident millimeter-wave signal, wherein the metallic layer comprises a plurality of rectangles arranged in a grid pattern radially varying in size within circumferential regions, wherein the first portion has a polarization substantially orthogonal to the incident millimeter-wave signal, wherein the first portion comprises cross-polarized components of the incident millimeter wave signal comprising a substantially collimated and coherent wavefront in a first direction, and wherein the remaining portions comprise a substantially collimated and coherent wavefront in a second direction.

12. A planar multi-layer transreflector for generating collimated coherent energy comprising:

three metallic layers, each having a plurality of conductive rectangles arranged in a grid pattern radially varying in size within each of a plurality of circumferential regions; and two insulating layers, each disposed between two of the metallic layers, wherein the plurality of rectangles are electrically coupled by connecting lines in either an x-direction or a y-direction, and wherein the circumferential regions are defined by concentric circles about a center of the transreflector.

13. The planar transreflector of claim 12 wherein the plurality of rectangles are arranged in a grid pattern radially varying in size from smaller to larger within each of the circumferential regions.

14. A planar multi-layer transreflector for generating collimated coherent energy comprising:

three metallic layers, each having a plurality of rectangles arranged in a grid pattern radially varying in size within each of a plurality of circumferential regions; and two insulating layers, each disposed between two of the metallic layers, wherein the plurality of rectangles are electrically coupled by connecting lines in either an x-direction or a y-direction, wherein the plurality of rectangles are arranged in a grid pattern radially varying in size from larger to smaller within each of the circumferential regions.

15. A planar multi-layer transreflector for generating collimated coherent energy comprising:

three metallic layers, each having a plurality of rectangles arranged in a grid pattern radially varying in size within each of a plurality of circumferential regions; and two insulating layers, each disposed between two of the metallic layers, wherein the plurality of rectangles are electrically coupled by connecting lines in either an x-direction or a y-direction, wherein a cross-polarized component of an incident millimeter-wave signal is substantially reflected in a collimated coherent wavefront, wherein remaining portions of the incident millimeter-wave signal are substantially transmitted through the transreflector in a collimated coherent wavefront, wherein the reflected cross-polarized component of the incident millimeter-wave signal is substantially orthogonal to the incident millimeter-wave signal, and wherein the remaining portions comprises a substantially collimated and coherent wavefront.

16. The transreflector of claim 15 wherein radial spacing between the circumferential regions, size and variation of the rectangles, a spacing between the rectangles, and a width of the connecting lines are selected to generate a substantially collimated and substantially coherent wavefront of the remaining portions from the incident millimeter-wave signal.

17. A system for generating collimated coherent millimeter-wave energy comprising:

a planar multilayer transreflector comprising a plurality of insulating layers arranged between metallic layers; and a millimeter-wave source positioned at a focus of the transreflector to provide an incident millimeter-wave signal, wherein the metallic layers each comprise a plurality of conductive rectangles arranged in a grid pattern radially varying in size within circumferential regions to allow the multilayer transreflector to substantially reflect a first portion of the incident millimeter-wave signal and to substantially transmit remaining portions of the incident millimeter-wave signal through the transreflector, wherein the first portion has a polarization substantially orthogonal to the incident millimeter-wave signal, wherein the conductive rectangles are electrically coupled to at least some other rectangles within the circumferential regions, and wherein the circumferential regions are defined by concentric circles about a center of the transreflector.

18. The system of claim 17 wherein the plurality of rectangles vary in size radially outward within each of the circumferential regions, and wherein the plurality of rectangles are electrically coupled by connecting lines in either an x-direction or a y-direction to substantially reflect the first portion with the polarization substantially orthogonal to the incident millimeter-wave signal.

19. The system of claim 18 wherein the metallic layer is one of three metallic layers, and wherein the insulating layer is one of two insulating layers disposed between the metallic layers.

20. The system of claim 18 wherein millimeter-wave source generates the incident millimeter-wave signal being either right-hand or left-hand circularly polarized.

21. A system for generating collimated coherent millimeter-wave energy comprising:

a planar multilayer transreflector comprising a plurality of insulating layers arranged between metallic layers; and a millimeter-wave source positioned at a focus of the transreflector to provide an incident millimeter-wave signal, wherein the metallic layers each comprise a plurality of rectangles arranged in a grid pattern radially varying in size within circumferential regions to allow the multilayer transreflector to substantially reflect a first portion of the incident millimeter-wave signal and to substantially transmit remaining portions of the incident millimeter-wave signal through the transreflector, wherein the first portion has a polarization substantially orthogonal to the incident millimeter-wave signal, wherein the plurality of rectangles vary in size radially outward within each of the circumferential regions, wherein the plurality of rectangles are electrically coupled by connecting lines in either an x-direction or a y-direction to substantially reflect the first portion with the polarization substantially orthogonal to the incident millimeter-wave signal, and wherein radial spacing between the circumferential regions, size and variation of the rectangles, a spacing between the rectangles, and a width of the connecting lines are selected to generate a substantially collimated and substantially coherent wavefront of the remaining portions from the incident millimeter-wave signal, and to reflect a substantially collimated and substantially coherent wavefront comprising the cross-polarized components.

22. A system for generating collimated coherent millimeter-wave energy comprising:

a planar multilaver transreflector comprising a plurality of insulating layers arranged between metallic layers; and a millimeter-wave source positioned at a focus of the transreflector to provide an incident millimeter-wave signal, wherein the metallic layers each comprise a plurality of rectangles arranged in a grid pattern radially varying in size within circumferential regions to allow the multilayer transreflector to substantially reflect a first portion of the incident millimeter-wave signal and to substantially transmit remaining portions of the incident millimeter-wave signal through the transreflector, and wherein the first portion has a polarization substantially orthogonal to the incident millimeter-wave signal, wherein the plurality of rectangles vary in size radially outward within each of the circumferential regions, wherein the plurality of rectangles are electrically coupled by connecting lines in either an x-direction or a y-direction to substantially reflect the first portion with the polarization substantially orthogonal to the incident millimeter-wave signal, wherein the first portion comprises cross-polarized components of the incident millimeter wave signal, wherein the reflected cross-polarized component is substantially orthogonal to the transmitted remaining portions, and wherein the cross-polarized components comprise a substantially collimated and coherent wavefront.

23. A system for generating collimated coherent millimeter-wave energy comprising:

a planar multilayer transreflector comprising a plurality of insulating layers arranged between metallic layers; and a millimeter-wave source positioned at a focus of the transreflector to provide an incident millimeter-wave signal, wherein the metallic layers each comprise a plurality of rectangles arranged in a grid pattern radially varying in size within circumferential regions to allow the multilayer transreflector to substantially reflect a first portion of the incident millimeter-wave signal and to substantially transmit remaining portions of the incident millimeter-wave signal through the transreflector, wherein the first portion has a polarization substantially orthogonal to the incident millimeter-wave signal, wherein the plurality of rectangles vary in size radially outward within each of the circumferential regions, wherein the plurality of rectangles are electrically coupled by connecting lines in either an x-direction or a y-direction to substantially reflect the first portion with the polarization substantially orthogonal to the incident millimeter-wave signal, and wherein the millimeter-wave source comprises amplifier array positioned near a focal point of the transreflector, the amplifier array to receive a reflected cross-polarized component, amplify the received cross-polarized component and responsively transmit signals orthogonal to the received cross-polarized component.

24. The system of claim 23 wherein the amplifier array comprises a plurality of array elements, wherein each array element comprises:

an input antenna having a polarization to selectively receive the reflected cross-polarized component;

a millimeter-wave amplifier to amplify the reflected cross-polarized component; and an output antenna coupled to an output of the amplifier to transmit signals orthogonal to the cross-polarized component, wherein the array elements are to oscillate at a millimeter-wave frequency of the incident millimeter-wave signal.

* * * * *

UNITED STATES PATENT AND TRADEMARK OFFICE

CERTIFICATE OF CORRECTION

PATENT NO. : 7,304,617 B2
APPLICATION NO. : 11/100200
DATED : December 4, 2007
INVENTOR(S) : Lynch It is certified that error appears in the above-identified patent and that said Letters Patent is hereby corrected as shown below:

In column 6, line 66, delete "$\theta_i$" and insert -- $\theta_t$ --, therefor.

In column 7, line 3, delete "6." and insert -- $\theta$. --, therefor.

In column 12, line 21, in Claim 22, delete "multilaver" and insert -- multilayer --, therefor.

Signed and Sealed this

Ninth Day of September, 2008

JON W. DUDAS
*Director of the United States Patent and Trademark Office*